US009414697B2

(12) United States Patent
Parshad

(10) Patent No.: US 9,414,697 B2
(45) Date of Patent: Aug. 16, 2016

(54) PRIVACY SCREEN

(71) Applicant: Inscape Corporation, Holland Landing (CA)

(72) Inventor: David Parshad, Markham (CA)

(73) Assignee: INSCAPE CORPORATION, Holland Landing, Ontario (CA)

( * ) Notice: Subject to any disclaimer, the term of this patent is extended or adjusted under 35 U.S.C. 154(b) by 40 days.

(21) Appl. No.: 14/340,799

(22) Filed: Jul. 25, 2014

(65) Prior Publication Data

US 2016/0024787 A1 Jan. 28, 2016

(51) Int. Cl.
*A47G 5/00* (2006.01)
*E04B 2/74* (2006.01)

(52) U.S. Cl.
CPC ..... *A47G 5/00* (2013.01); *E04B 2/7422* (2013.01); *E04B 2/7427* (2013.01)

(58) Field of Classification Search
CPC ..... E04B 2/7416; A47G 5/00
USPC ..... 160/135, 351
See application file for complete search history.

(56) References Cited

U.S. PATENT DOCUMENTS

| | | | | |
|---|---|---|---|---|
| 5,431,263 | A * | 7/1995 | Nordstrom | A45C 13/262 190/18 A |
| 5,530,211 | A * | 6/1996 | Rogers | G10K 11/20 160/135 |
| 5,584,330 | A * | 12/1996 | Muller | A47G 5/00 160/135 |
| 5,675,946 | A | 10/1997 | Verbeek et al. | |
| D446,659 | S | 8/2001 | Ludwig et al. | |
| 6,510,663 | B2 | 1/2003 | Jourden | |
| 6,612,077 | B2 | 9/2003 | Parshad | |
| 6,896,028 | B2 * | 5/2005 | Brennan | A47B 97/00 160/351 |
| 7,975,445 | B2 | 7/2011 | Parshad et al. | |
| 8,196,365 | B2 | 6/2012 | Parshad | |
| 8,893,762 | B2 * | 11/2014 | Ryan | E04B 2/7425 160/135 |
| 2004/0140066 | A1 * | 7/2004 | Brennan | A47B 97/00 160/351 |
| 2012/0168097 | A1 * | 7/2012 | Gilbert | A47G 5/00 160/130 |

* cited by examiner

*Primary Examiner* — Katherine Mitchell
*Assistant Examiner* — Scott Denion
(74) *Attorney, Agent, or Firm* — Riches, McKenzie & Herbert LLP

(57) ABSTRACT

A modular privacy panel with a concave front surface and a parallel convex rear surface which panel is adapted to be disposed in side by side abutting relation with identical adjacent panels and provide a resultant combination screen with both faces appearing as a serpentine shape as seen in top view.

16 Claims, 21 Drawing Sheets

PRIVACY SCREEN

SCOPE OF THE INVENTION

This invention relates to privacy screens and, more particularly, to manually movable privacy screens for workplace environments.

BACKGROUND OF THE INVENTION

Privacy screens are known for use as in workplace environments to provide a visual divide between areas in a workplace. However, the present inventor has appreciated that known privacy screens suffer a number of disadvantages including those of being unable to provide for different pleasing appearances when located in different orientations and not having the capability for side by side abutting engagement in manners which advantageously locate the panels in pleasing arrays. The present inventor has also appreciated that known panels suffer the disadvantage of being cumbersome or awkward to move particularly when the panels may comprise more than one panel permanently connected together.

SUMMARY OF THE INVENTION

To at least partially overcome these disadvantages of previously known devices, the present invention provides in one aspect a modular privacy panel with a concave front surface and a parallel convex rear surface which panel is adapted to be disposed in side by side abutting relation with identical adjacent panels and provide a resultant combination screen with both faces appearing as a serpentine shape as seen in top view.

To overcome other disadvantages of the prior art, the present invention provides a novel wheeled arrangement facilitating manual movement of a privacy screen panel.

In one aspect, the present invention provides a modular privacy screen panel comprising:

a floor engaging base, a screen supported on the base and extending vertically upwardly from the base, the screen having a front surface extending from a screen bottom proximate the base upwardly to a screen top and spanning between a first screen side and a second screen side, the front surface being a concave curved surface as seen in top view, the screen having a rear surface extending from the screen bottom proximate the base upwardly to the screen top and spanning between the first screen side and the second screen side, the rear surface being a convex curved rear surface parallel to the front surface, the base being elongate and extending along a straight base longitudinal from a first base side edge underneath the first screen side to a second base side edge underneath the second screen side, the first base edge being straight and normal to the base longitudinal, the second base side edge being straight and parallel to the first base side edge.

In another aspect, the present invention provides a privacy screen panel comprising:

a floor engaging base, a central screen supported on the base and extending vertically upwardly from the base, the screen having a front surface extending from a screen bottom proximate the base upwardly to a screen top and spanning between a first screen side and a second screen side, the screen having a rear surface extending from the screen bottom proximate the base upwardly to the screen top and spanning between the first screen side and the second screen side, a first wing screen pivotably mounted to the central screen along the first screen side for pivoting about a vertical first axis from a closed position in which the first wing screen overlies the central screen to opened positions in which the first wing screen extends laterally away from the central screen, a second wing screen pivotably mounted to the central screen along the second screen side for pivoting about a vertical second axis from a closed position in which the second wing screen overlies the central screen to opened positions in which the second wing screen extends laterally away from the central screen, the base being elongate and extending along a straight base longitudinal from a first base side edge underneath the first screen side to a second base side edge underneath the second screen side, the base having a front base edge extending from the first base side edge to the second base side edge, the base having a rear base edge extending from the first base side edge to the second base side edge, a wheel member journalled to the base for rotation about an axis parallel the longitudinal, the wheel member carried by the base such that when the base in a supporting rest position engages the floor to support the central screen to extend vertically upwardly therefrom the wheel member is spaced from engagement with the floor, however, when the panel is pivoted relative the floor about the axis to a tilted transport position, the wheel member engages the floor for rolling engagement facilitating manual rolling movement of the panel while maintained in the transport position along the floor in a direction normal to the axis.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
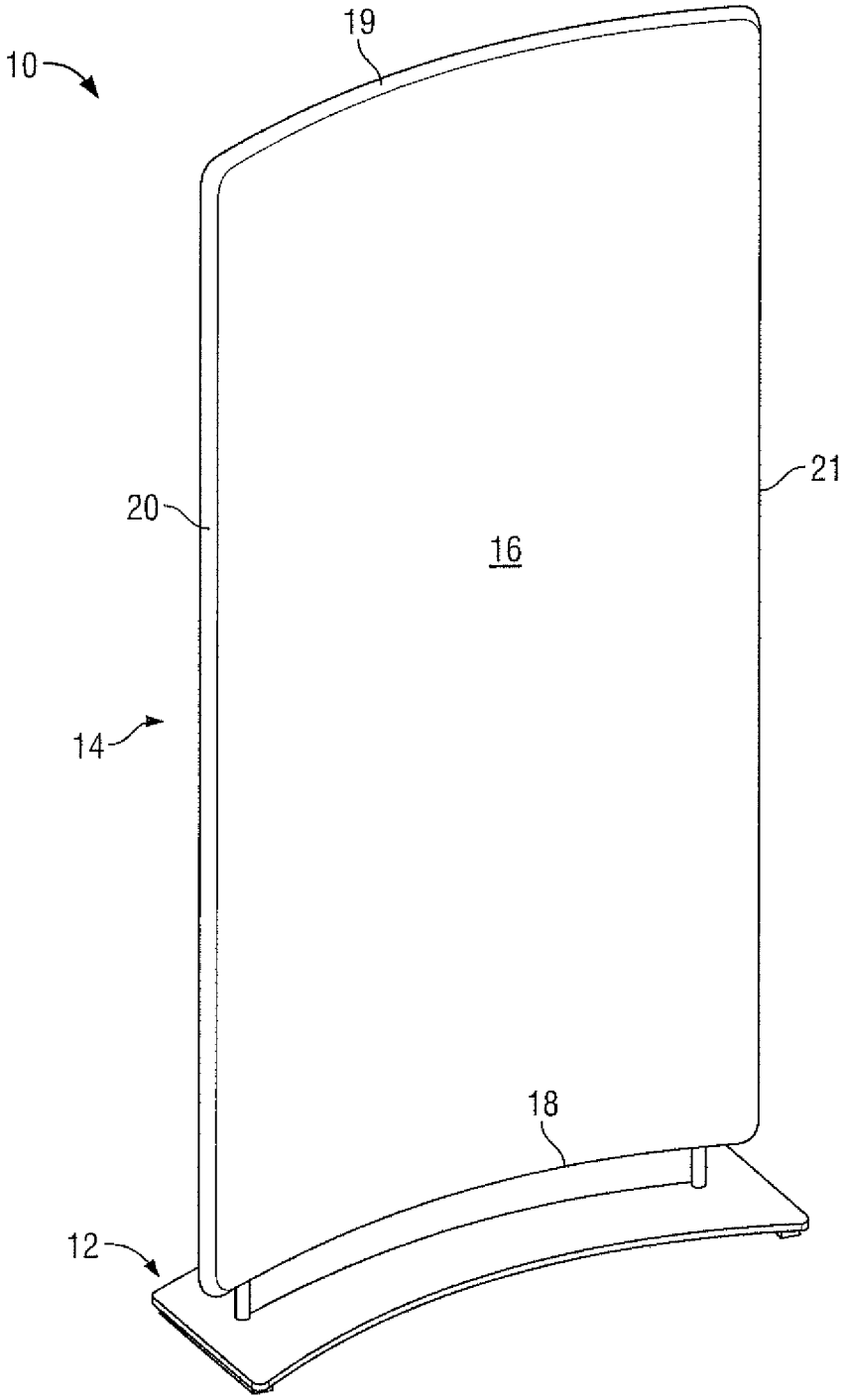
FIG. 1 illustrates a modular privacy screen panel in accordance with a first embodiment of the present invention.
Figure 2:
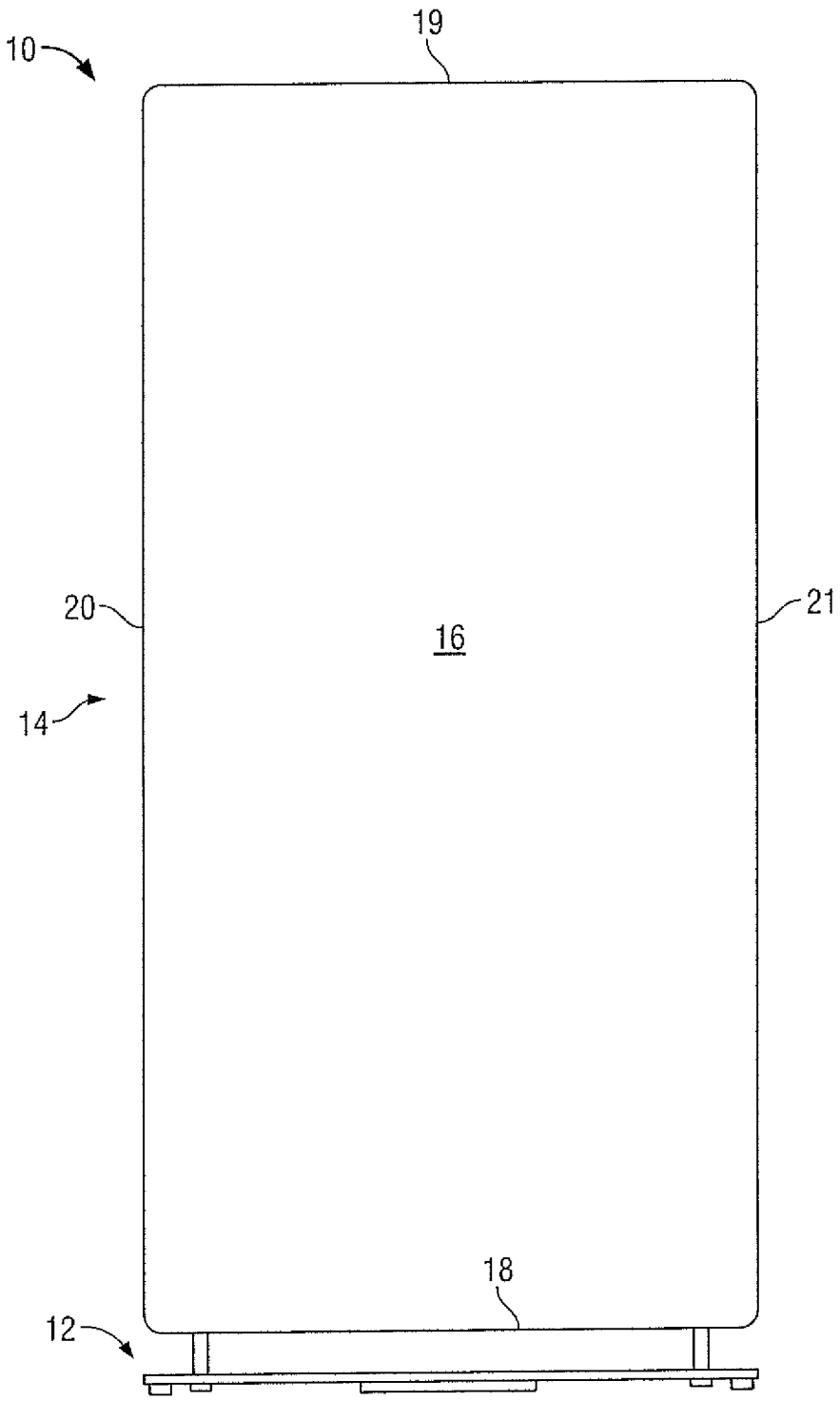
FIGS. 2, 3, 4, 5, 6 and 7 are, respectively, a front, a back, a top, a bottom, a left side and a right side view of the panel of FIG. 1.
Figure 3:
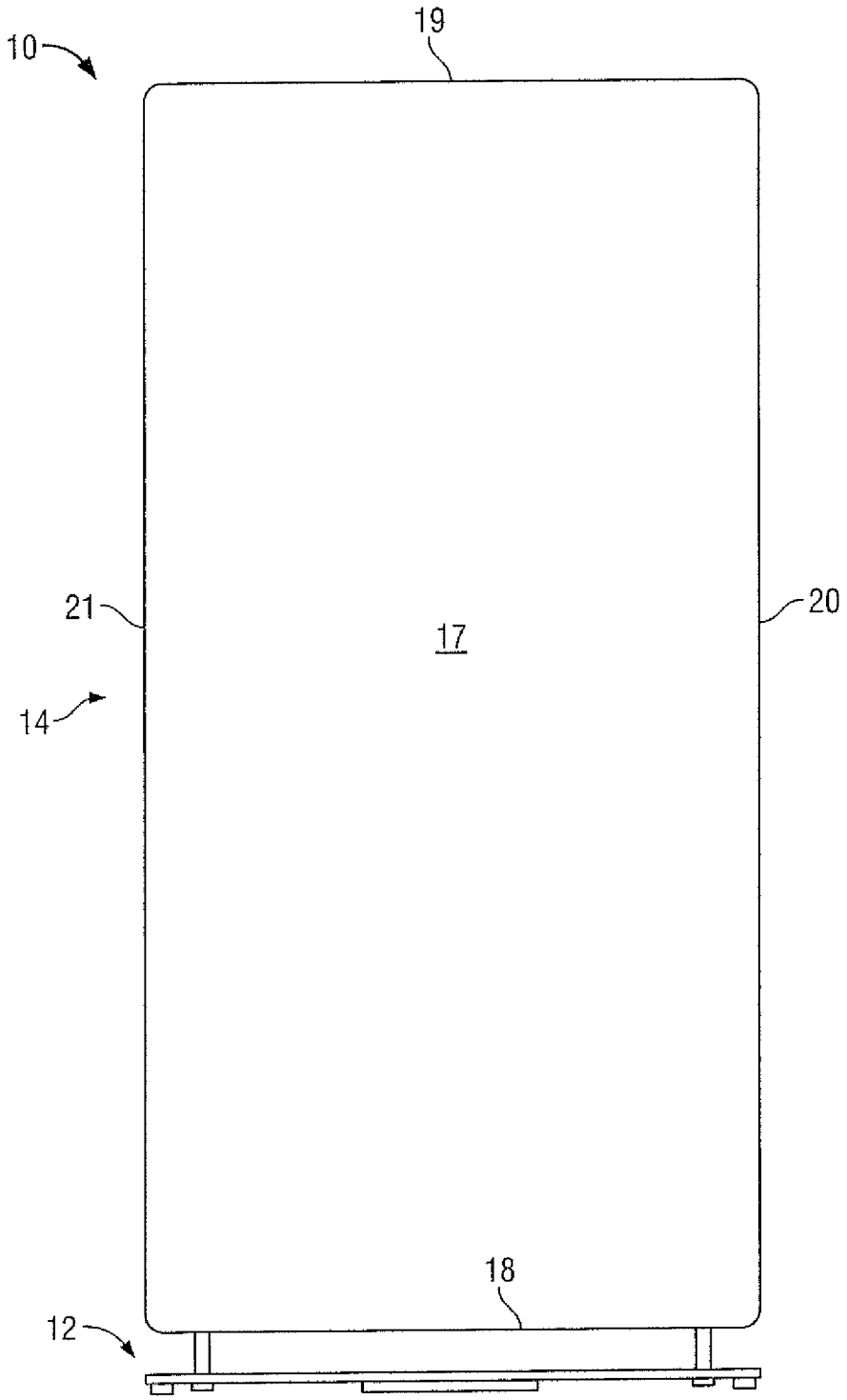

Reference is made to FIG. 1 which illustrates a modular privacy screen panel 10 in accordance with the first embodiment of the present invention. The panel comprises a floor engaging base 12 and a screen 14 supported on the base 12 and extending vertically upwardly from the base 12. The screen 14 has a front surface 16 extending from a screen bottom 18 proximate the base 12 upwardly to a screen top 19 and spanning between a first screen side 20 and a second screen side 21. The front face 16 is a concave curved surface as seen in top view in FIG. 4. The screen 14 has a rear surface 17 extending from the screen bottom 18 proximate the base 12 upwardly to the screen top 19 and also spanning between the first screen side 20 and the second screen side 21.

Figure 4:
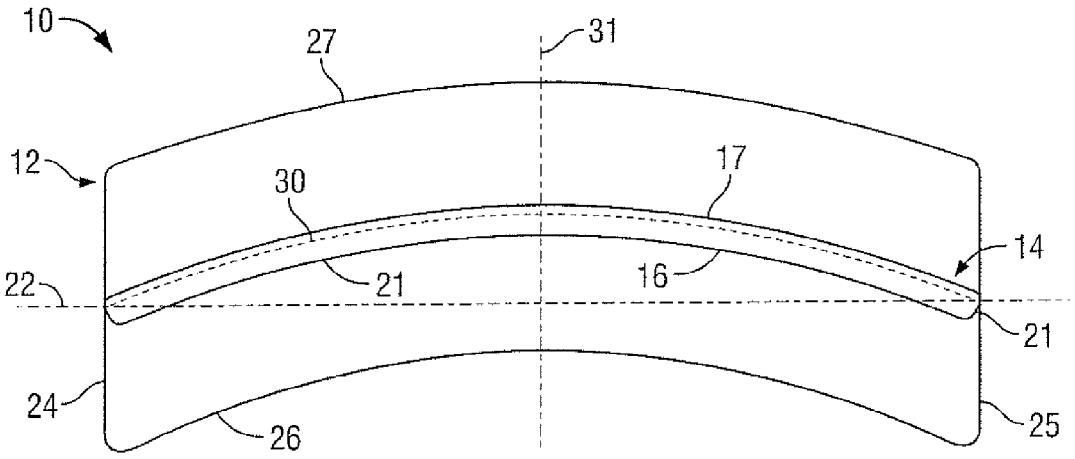
Figure 5:
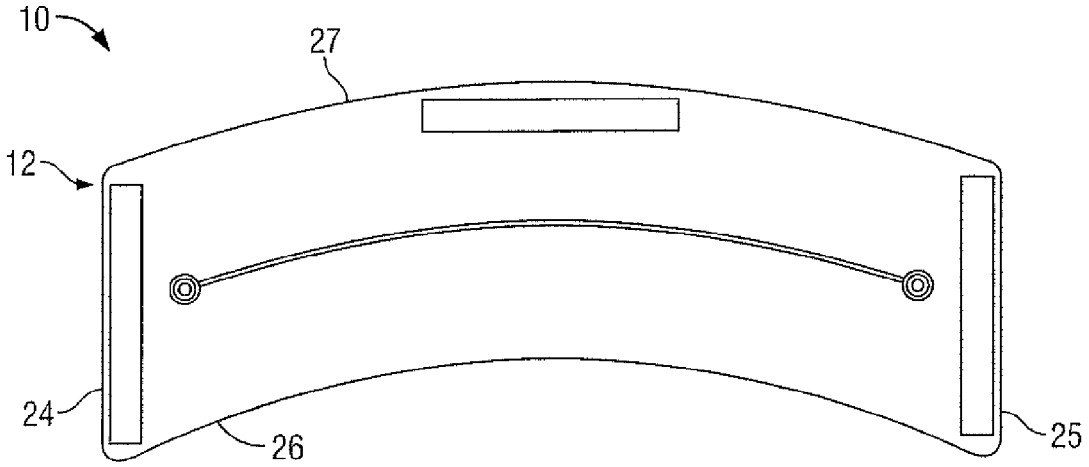
Figure 6:
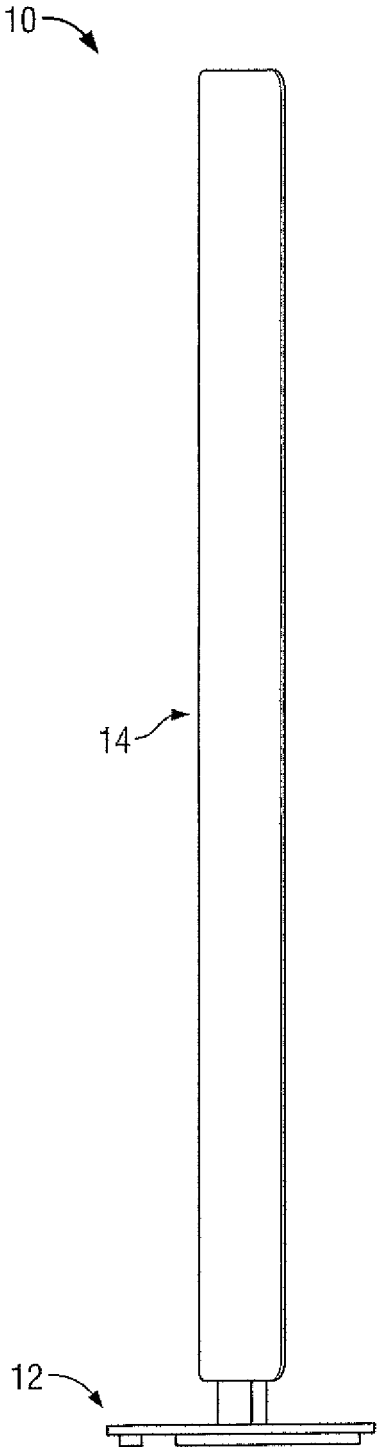
Figure 7:
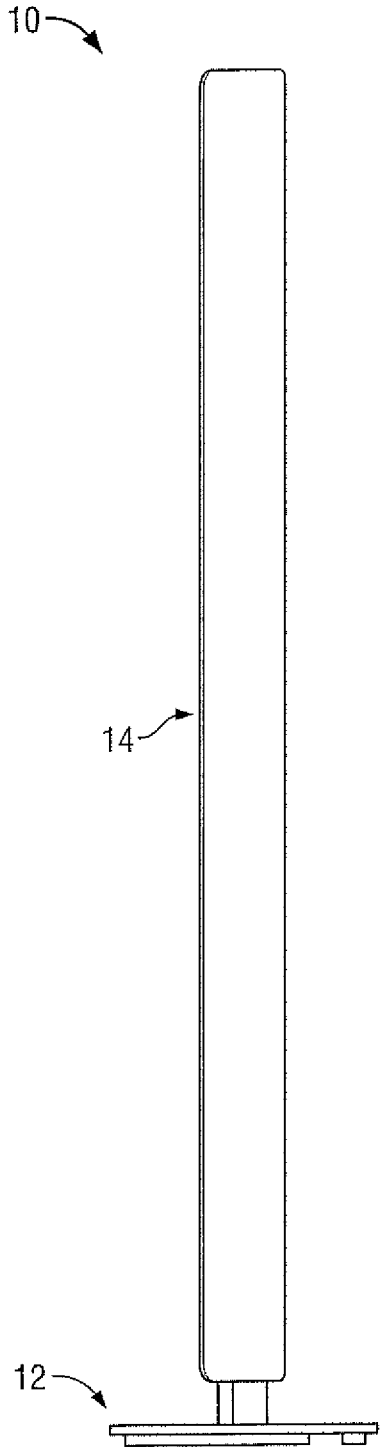

As seen in FIG. 4, the rear surface 17 is a convex curved rear surface parallel to the front surface 16. Each of the front surface 16 and the rear surface 17 extend vertically upwardly from the base 12. The base 12 is elongate side to side and extends along a notional straight base longitudinal indicated by the dashed line 22 from a first base side edge 24 underneath the first screen side 20 to a second base side edge 25 underneath the second screen side 21. The first base side edge 24 is straight and extends normal to the base longitudinal 22. The second base side edge 25 is also straight and is parallel to the first base side edge 24 and hence is also normal to the base longitudinal 22.

As best seen in FIG. 4, the first screen side 20 does not extend laterally beyond the first base side edge 24 and the second screen side 21 does not extend laterally beyond the second base side edge 25. Preferably, as seen in FIG. 4, the first screen side 20 ends laterally in a vertical extension of the first base side edge 24 and the second screen side 21 ends laterally at a vertical extension of the second base side edge 25.

The base has a front base edge 26 extending from the first base side edge 24 to the second base side edge 25. The front base edge 26 is a concave curved surface as seen in top view in FIG. 4 parallel to the front surface 16. The base 12 has a rear base edge 27 extending from the first base side edge 24 to the second base side edge 25. The rear base edge 27 is a concave curved surface parallel to the front base edge 26. As seen in FIG. 4 in the preferred embodiment, each of the front base edge 26, the rear base edge 27, the front surface 16 and the rear surface 17 are parallel curved surfaces identical to a dashed line curved surface 30 indicated in FIG. 4 which represents a cord of a circle which cord extends between the intersection of the longitudinal 22 with each of the first base edge 24 and the second base edge 25. Thus, the panel as seen in FIG. 4 is symmetrical about a center line 31 normal to the longitudinal 22 parallel each of the first base edge 24 and the second base edge 25 and centered between the first base edge 24 and the second base edge 25.

Figure 8:
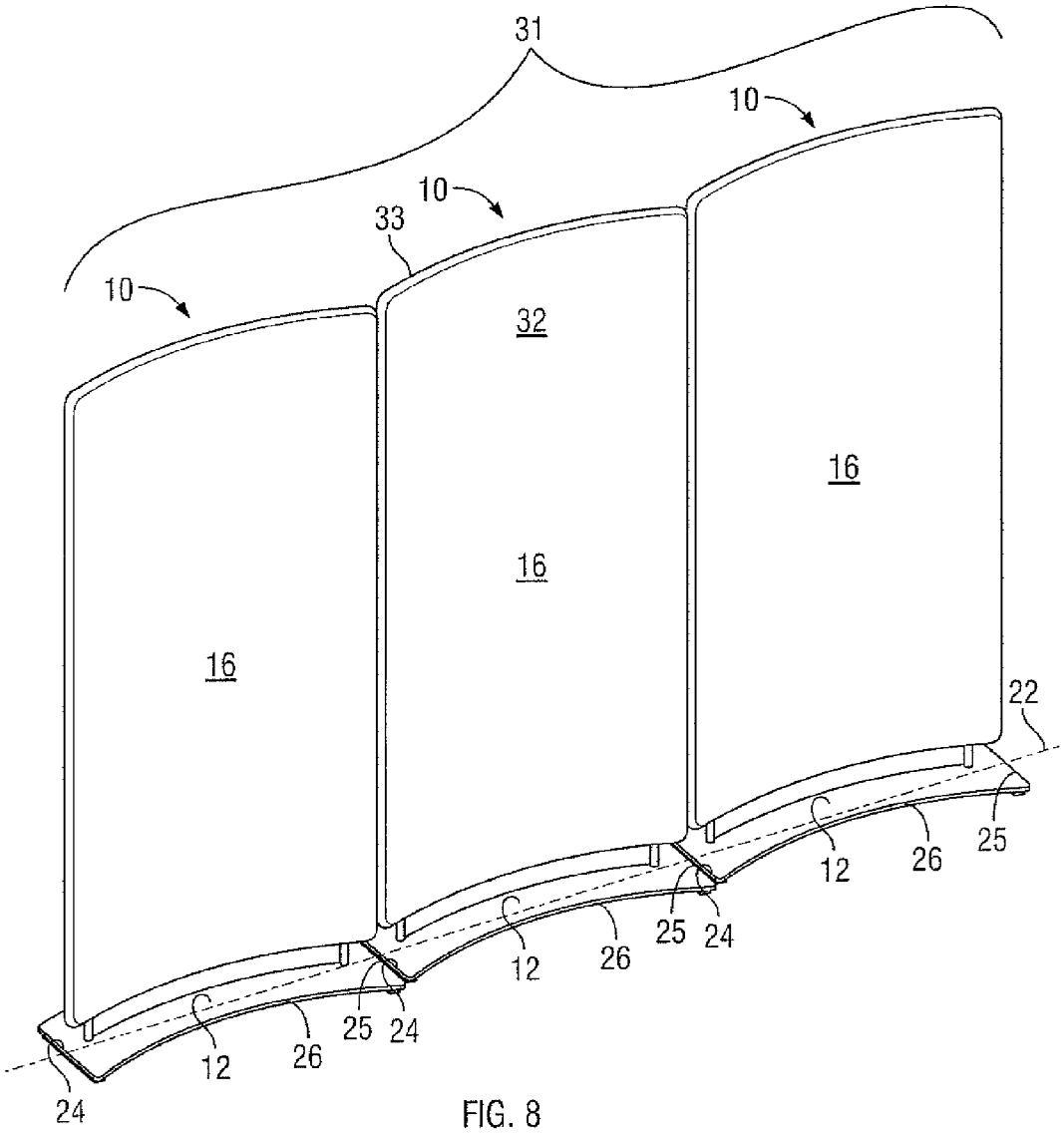
FIG. 8 is a combination screen formed from three identical panels as shown in FIG. 1 arranged side-by-side with a concave front surface of each panel directed in the same direction.
Figure 9:
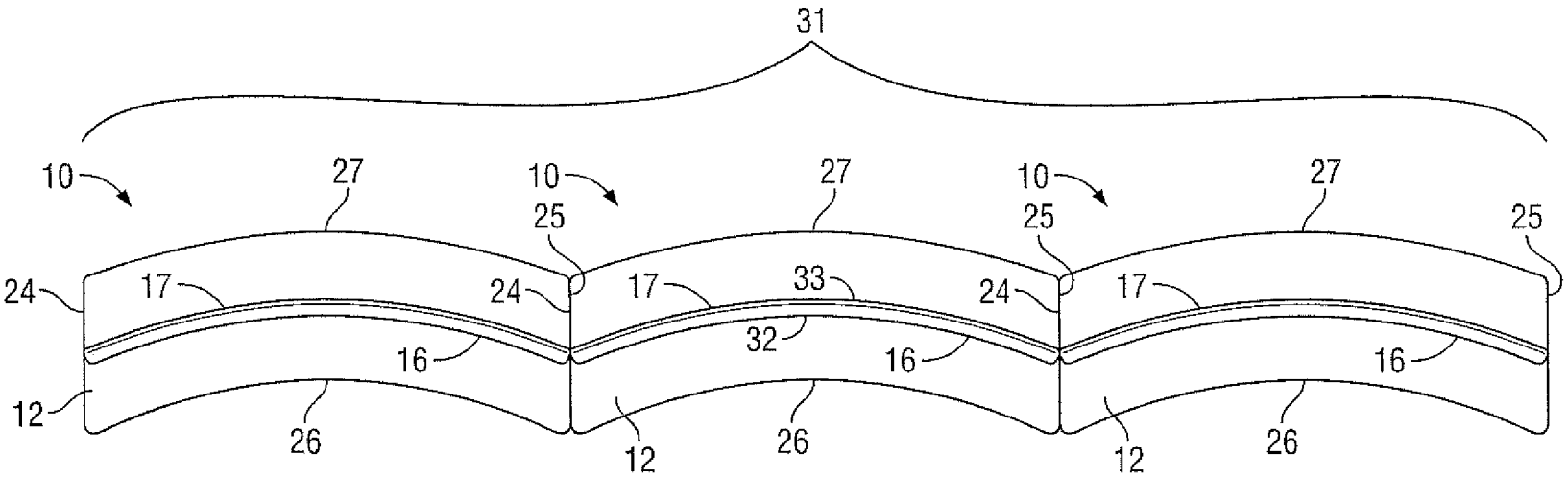
FIG. 9 is a top view of the first combination screen shown in FIG. 8.

Reference is made to FIG. 8 which illustrates a first combination screen 31 in accordance with the present invention formed from three identical panels 10 as shown in FIG. 1. The three panels 10 are located on a floor in a side by side relation with the longitudinal 22 of each panel disposed in alignment. Where the panels abut each other, the first base side edge 24 of a first of the panels engages in a coplanar abutting relation with the second base side edge 25 of a second of the panels such that a first face 32 of the first combination screen has the front surface 16 of each of the panels directed in a first direction and a second face 34 of the first combination screen has the rear surface 17 of each of the panels directed in a second opposite direction. That is to say, the first face of the first combination screen has the concave curved front surfaces 16 all directed in the same direction.

Figure 10:
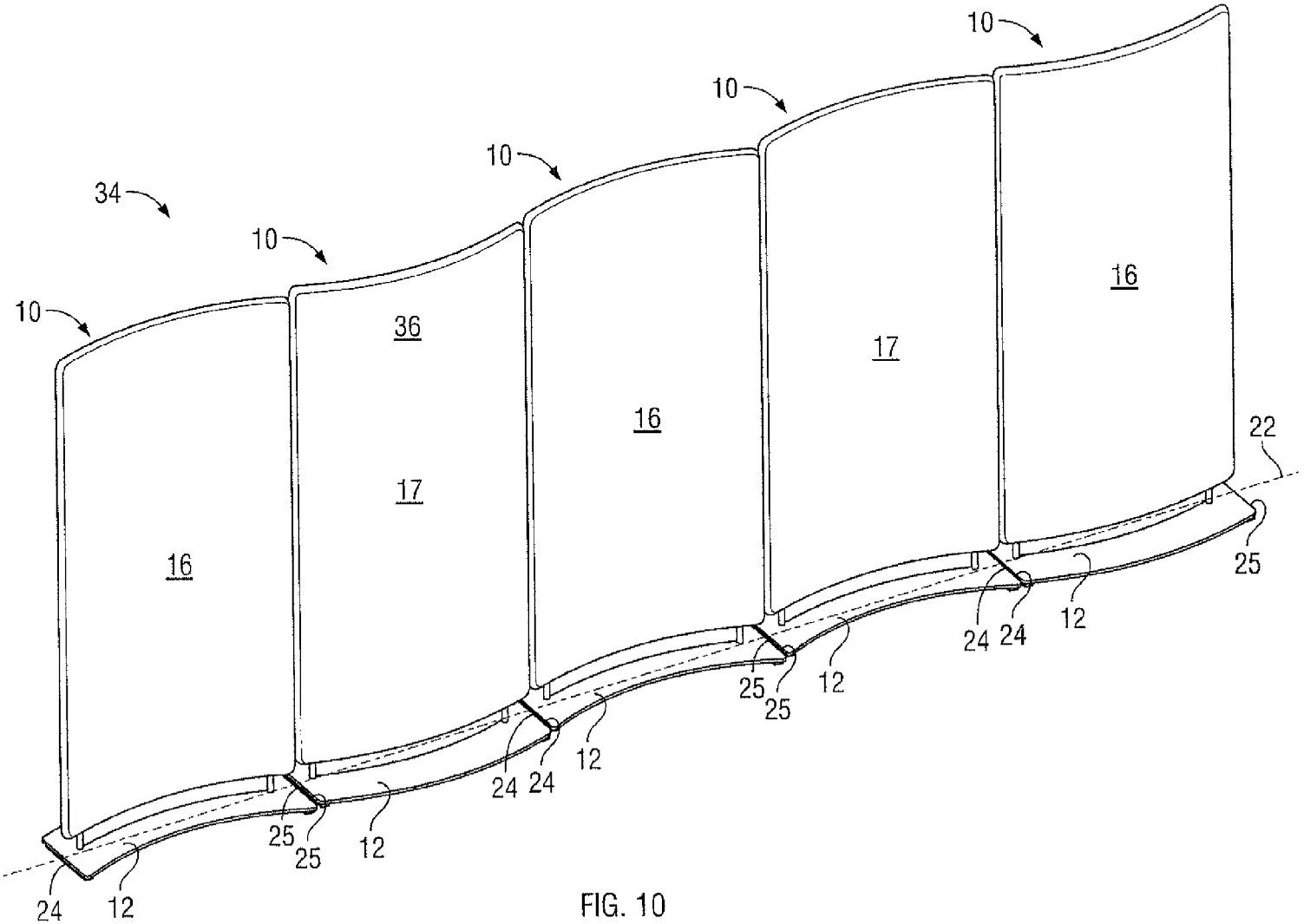
FIG. 10 is a perspective view of a second combination screen formed from five identical panels as shown in FIG. 1 arranged side-by-side with each face of the combination screen having a serpentine shape as seen in top view.
Figure 11:
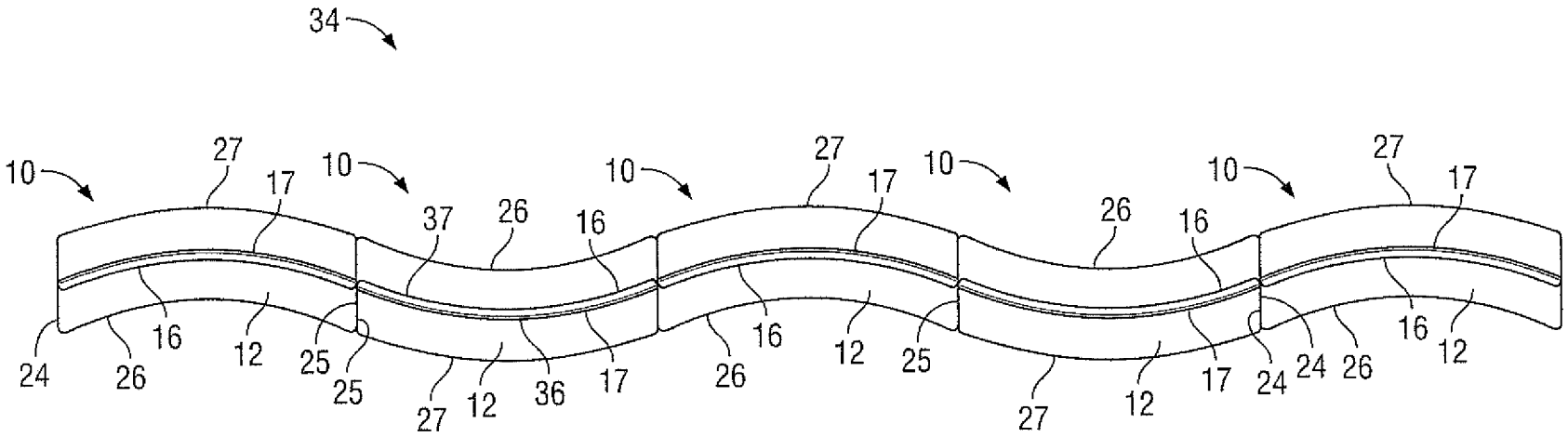
FIG. 11 is a top view of the second combination screen as shown in FIG. 10.

Reference is made to FIGS. 10 and 11 which show a second combination screen 34 formed by five identical panels 10, as shown in FIG. 1, supported on a floor in a side by side relation with the longitudinal 22 of each panel 10 disposed in alignment. For each abutting pair of panels 10, the first base side edge 24 of a first of the panels engages in a coplanar abutting relation with the first base side edge 24 of a second of the panels 10. As seen, each of a first face 36 and a second face 37 of the second combination screen has a serpentine shape as seen in top view in FIG. 11 with the front surface 16 of a first panel directed in a first direction and a rear surface of an adjacent second panel 10 directed in the same direction and similarly with the rear face 17 of a first panel 10 directed in a second direction and the front surface 16 of an adjacent second panel 10 directed in the same second direction.

As can be seen in FIGS. 8 to 11, the first base side edge 24 and the second base side edge 25 provide abutting surfaces which serve to locate adjacent panels 10 in a side by side relation so as to provide, for example, adjacent panels with their bases to have either an alternating arrangement and a serpentine shape as seen in FIG. 10 or an identical orientation in appearance as seen in FIG. 8.

Each of the privacy panels 10 are preferably of a size and a weight which permits each panel to be manually moved preferably by one individual but possibly by two individuals for repositioning on the floor relative to the other panels as may be desired.

The screen of each panel 10 is preferably to be provided of a sound dampening material.

Figure 12:
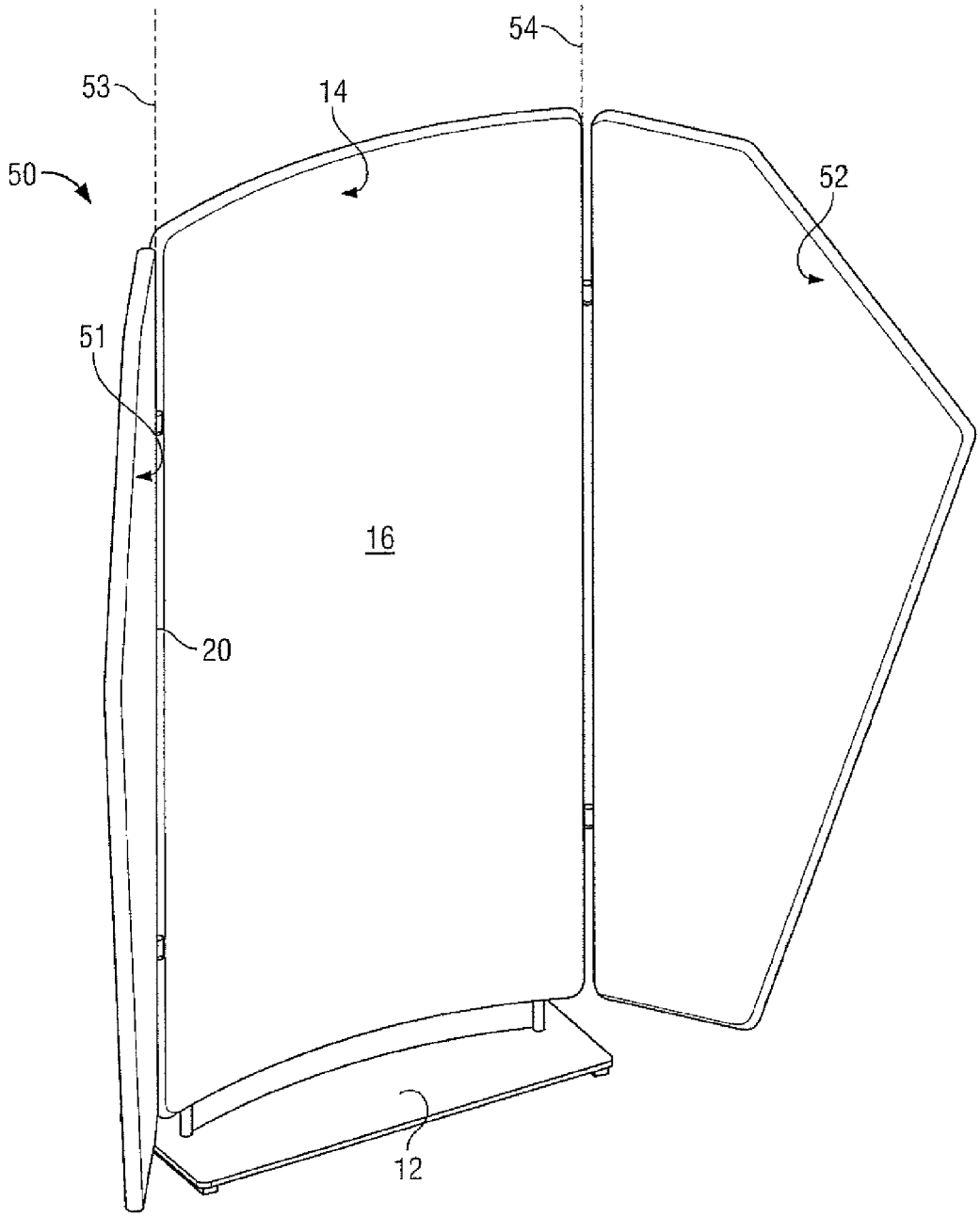
FIG. 12 is a perspective view of a winged privacy screen in accordance with a second embodiment of the present invention in a first open position.

Reference is made to FIGS. 12 to 20 which illustrate a second embodiment of a privacy screen panel 50 in accordance with the present invention. Elements of a screen panel 50 in a second embodiment are similar to elements in the first embodiment and similar reference numerals are used to refer to similar elements. A panel 50 of FIG. 12 is to be considered a winged privacy screen panel which includes not only a central screen 14 substantially identical to that illustrated in the first embodiment but also a first winged screen 51 and a second winged screen 52. As can be seen in FIG. 12, the first winged screen 51 is pivotally mounted to the central screen 14 along the first screen side 20 for pivoting about a first vertical axis 53. Similarly, the second winged screen 52 is pivotally mounted to the central screen 14 along the second screen side 21 for pivoting about a vertical second axis 54.

The panel 50 has a floor engaging base 12 and the central screen 14 is supported on the base 12 to extend vertically upwardly from the base 12. The central screen 14 has a front surface 16 spanning between the first screen side 20 and the second screen side 21. In the preferred embodiment, the front surface 16 is a concave curved surface as seen in top view. The screen has a rear surface 17 which is a concave curved rear surface parallel to the front surface 16.

The base 14 is shown as being elongate and extending along a straight base longitudinal 22 from a first base side edge 24 to a second base side edge 25. The base has a front base edge 26 extending from the first base side edge 24 to the second base side edge 25. The base has a rear base edge 27 extending from the first base side edge 24 to the second base side edge 25.

Figure 19:
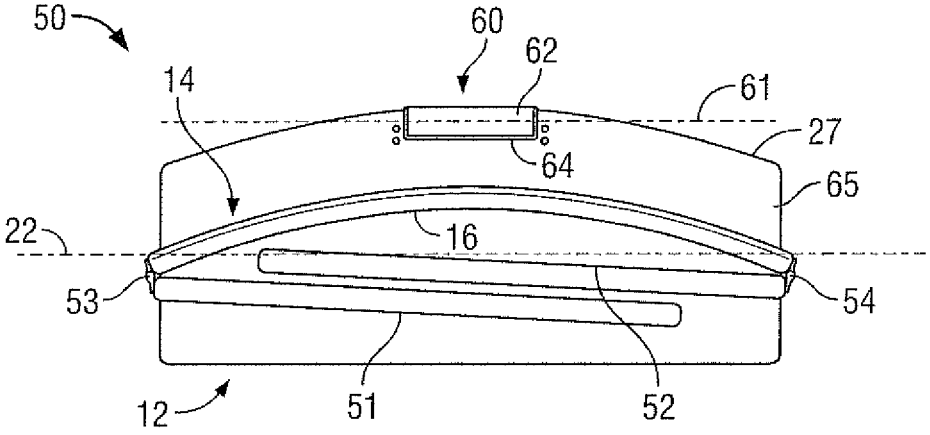
FIG. 19 is a top view of the panel of FIG. 11 in a closed position.

Reference is made to FIG. 19 which illustrates the winged panel 50 with each of the first wing screen 51 and the second wing screen 52 in a closed position. As seen in FIG. 19 in the closed position, the first wing screen 51 pivots about the first axis 53 to overlie the front surface 16 of the central screen 14. Similarly, in the closed position of FIG. 19, the second wing screen 52 is pivoted about the second axis 54 to the closed position in which the second wing screen 52 overlies the front surface 16 of the central screen 14. From the closed position shown in FIG. 19, the first wing screen 51 may be pivoted about the first axis 53 to open positions including an open position as shown in FIG. 12 in which the first wing screen 51 extends laterally away from the central screen 14. Similarly, the second wing screen 52 can be pivoted about the second axis 54 from the closed position shown in FIG. 19 to open positions including an open position as shown in FIG. 12 in which the second wing screen 52 extends laterally away from the central screen 14.

Figure 13:
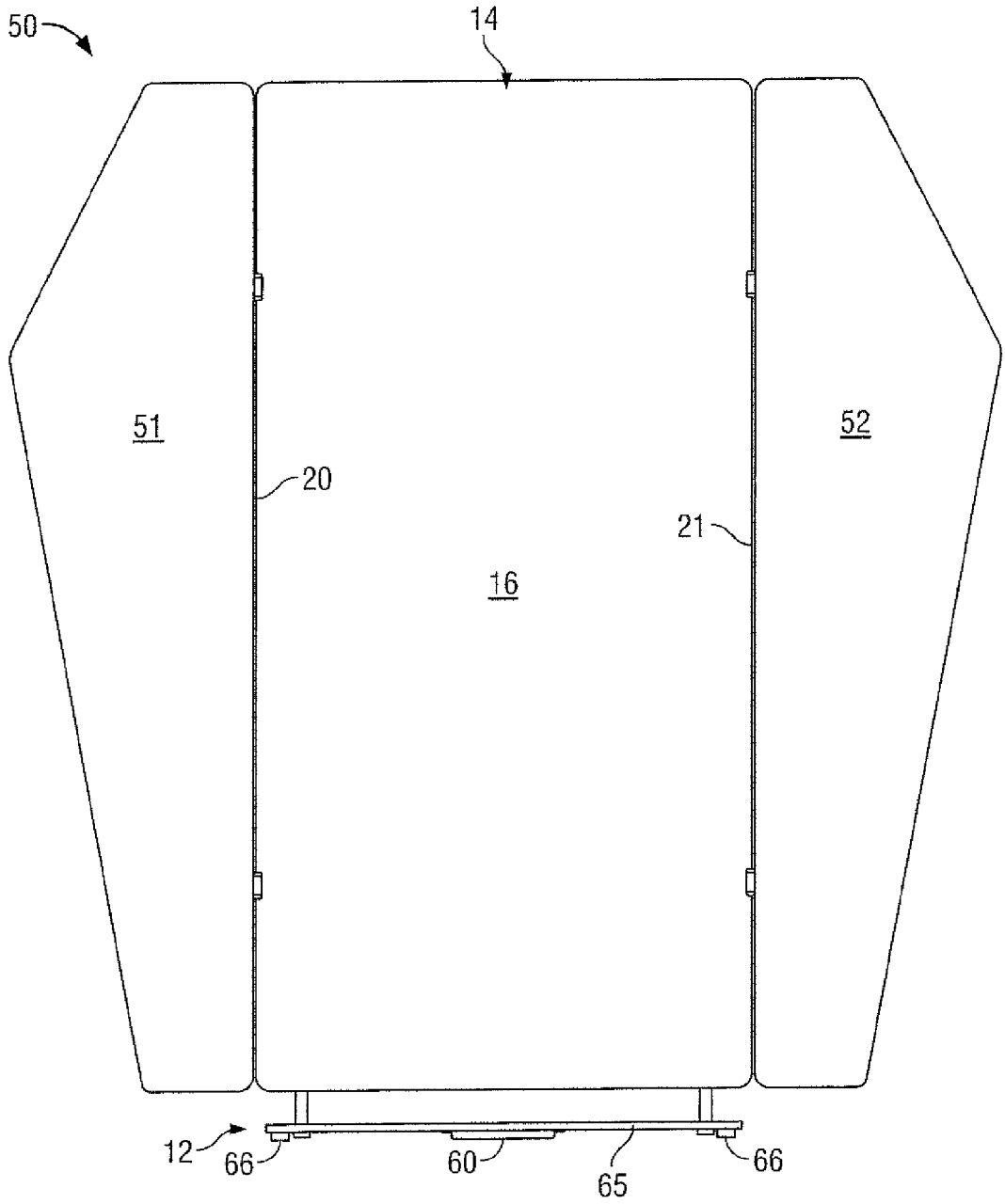
FIGS. 13, 14, 15, 16, 17 and 18 comprise, respectively, a front, a back, a top, a bottom, a left side and a right side view of the screen of FIG. 12.
Figure 14:
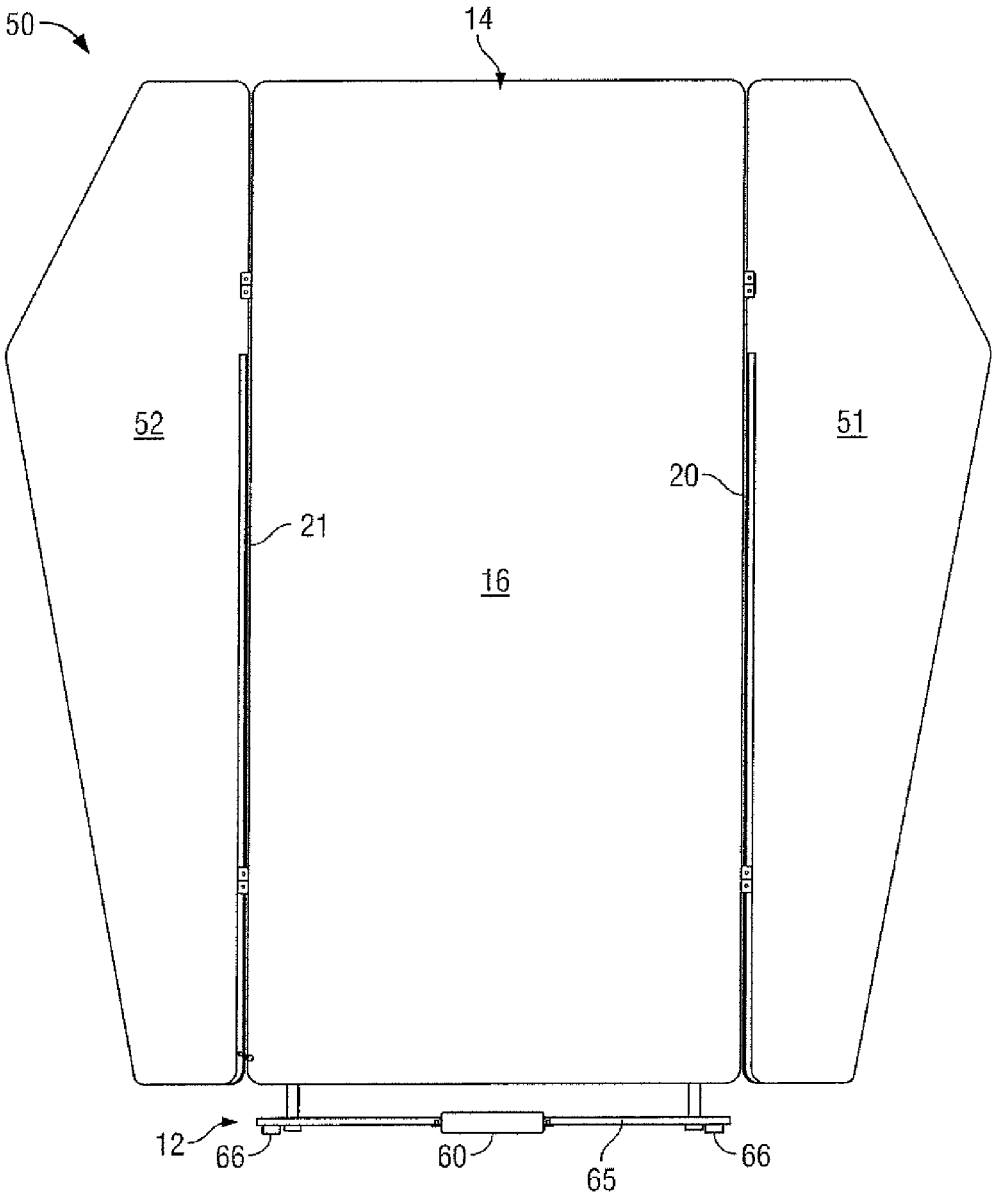
Figure 15:
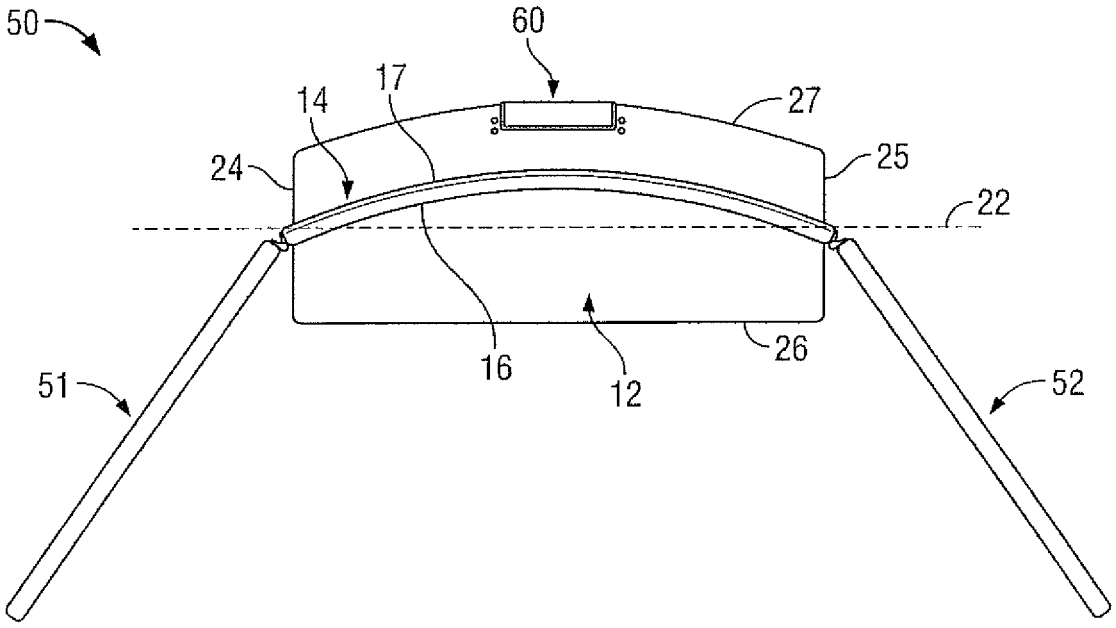
Figure 16:
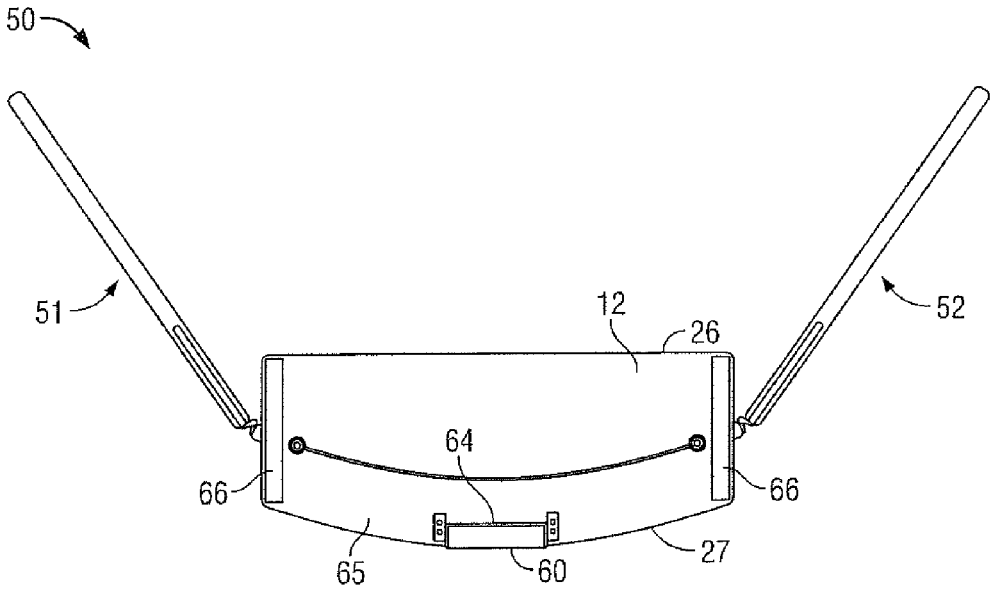
Figure 17:
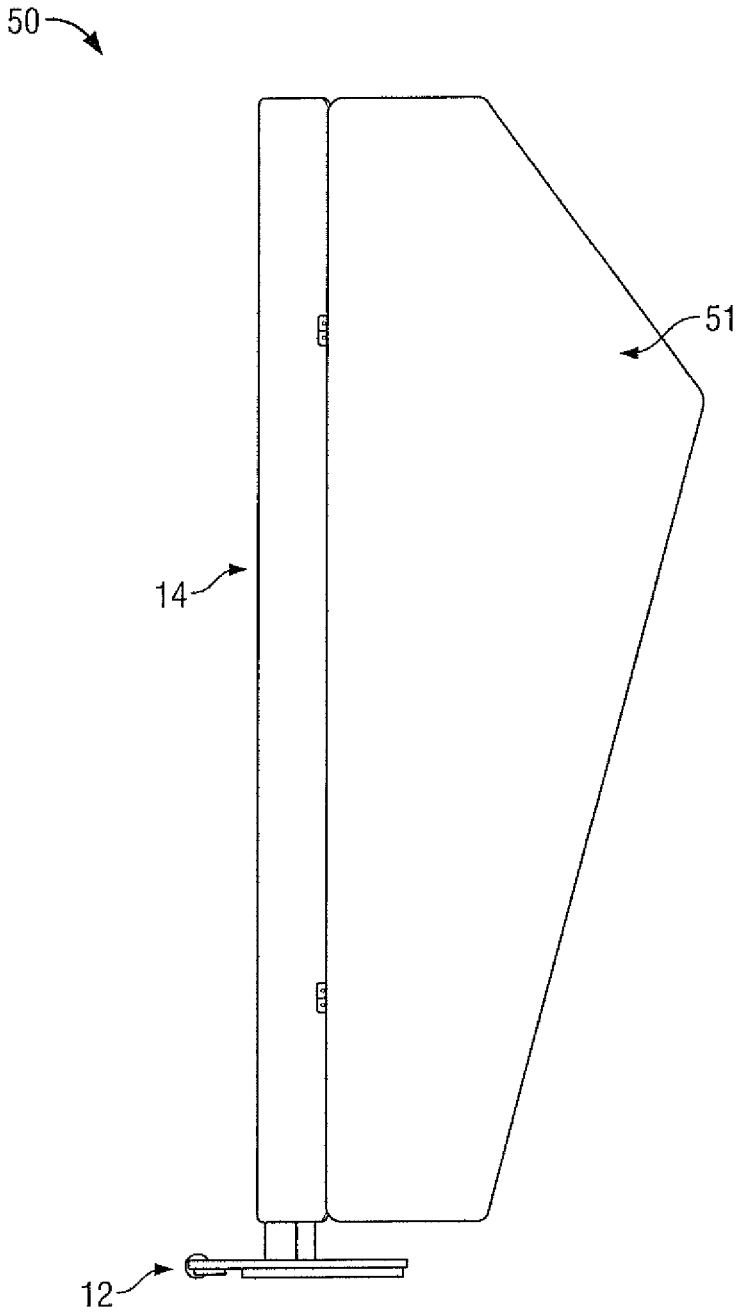
Figure 18:
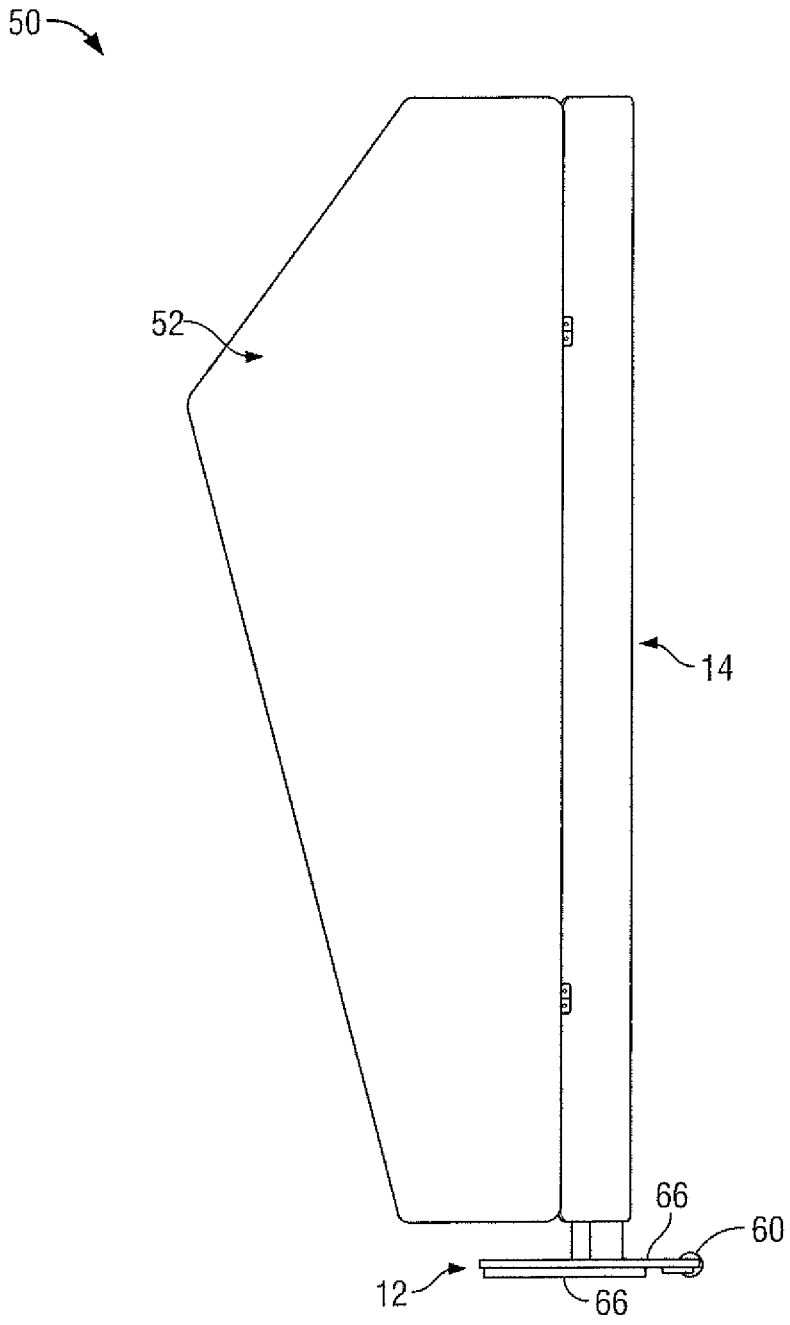
Figure 20:
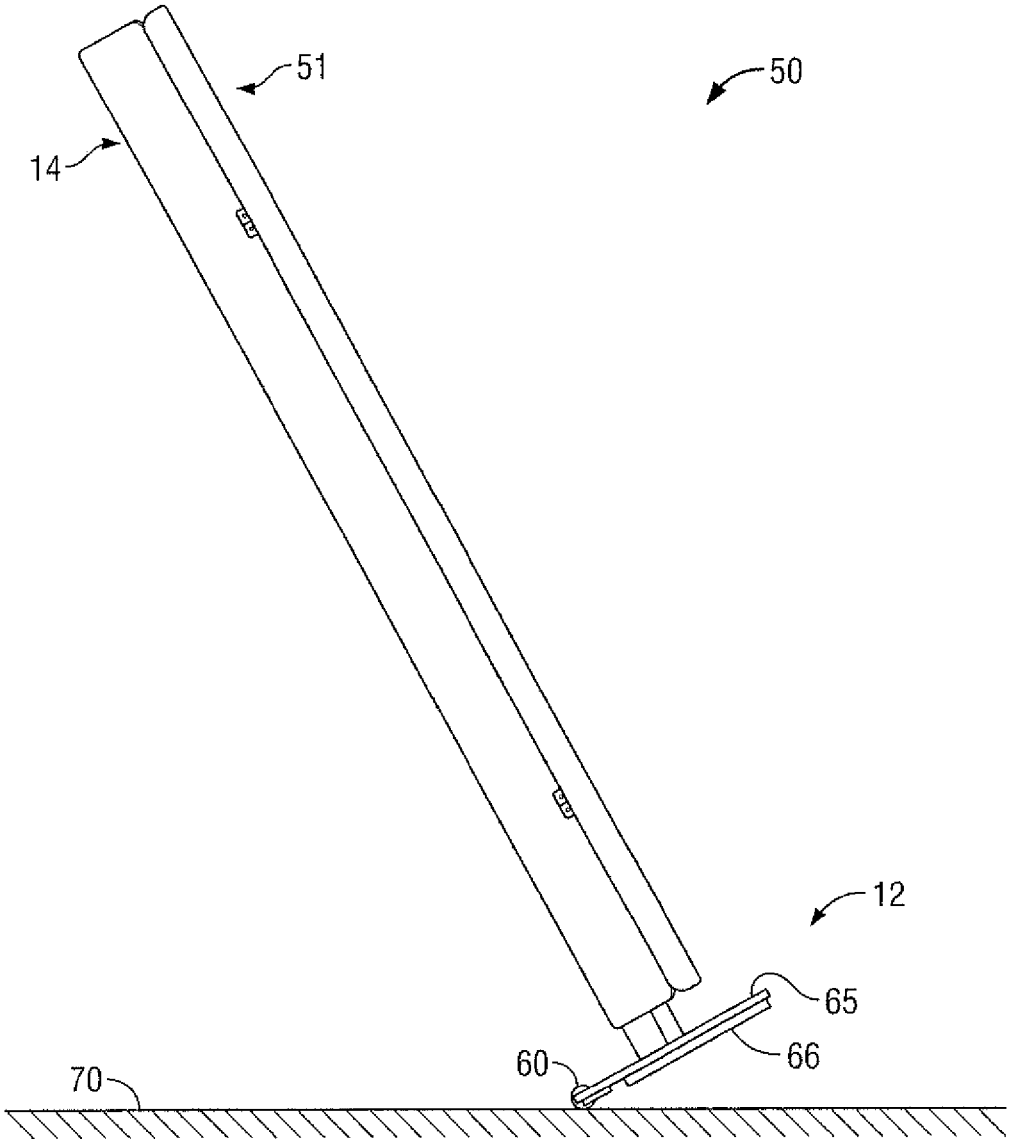
FIG. 20 is a right side view of the panel of FIG. 17 in a closed position in a position for rolling transport over a floor.

A wheel member 60 is journalled to the base 12 for rotation about a wheel axis 61 parallel the longitudinal 22. The wheel member 60 comprises an elongate roller with a floor engaging surface 62 disposed coaxially about the axis 61. The base 12 includes support plate 65 and a slot 64 vertically therethrough adjacent its base rear edge 27. The slot 64 extends parallel the wheel axis 61. The roller wheel member 60 is mounted on an axle (not shown) extending parallel the wheel axis 61 with the roller wheel member 60 located within the slot 64 such that the floor engaging surface 62 extends marginally rearwardly of the base 12, that is, marginally rearwardly of the rear base edge 27 as seen in FIGS. 15 and 16 and marginally downwardly below the base 12 proximate its rear base edge. As seen in FIGS. 13, 14, 17 and 18 and particularly in the bottom view of FIG. 16, the base 12 includes the upper horizontally disposed support plate 65 from which two flooring engaging support bars or feet 66 extend downwardly to engage the floor. When the panel 50 is in a supporting rest position such as shown in FIG. 13, the base 12 engages a floor to support the central panel 14 to extend vertically upwardly from the base 12 and the wheel member is in engagement with the floor to assist with the feet 66 in supporting the panel 50 vertically. From a supporting rest position as shown in FIG. 12, the first winged screen 51 and the second winged screen 52 may be moved to the closed position as shown in FIG. 19. Subsequently, the panel 50 may then be pivoted relative the floor 70 about the axis 61 to a tilted transport position as shown in FIG. 20 in which the wheel member 60 engages the floor 70 for rolling engagement with the floor 70 facilitating manual rolling movement of the panel 50 while maintained in a transport position along the floor 70 in a direction normal to the axis 61.

As can be seen in the top views of FIGS. 15 and 19, the rear base edge 27 is a convex curved surface. The wheel member 60 is centered relative the base 12 between the base first side edge 24 and the base second side edge 25 to locate the wheel member 60 at a location where the convex curved rear base edge 27 extends farthest rearwardly relative the longitudinal 22 of the base 12 and assists in facilitating on tilting of the panel 50 from the supporting rest position of FIG. 19 to the tilted transport position of FIG. 20 that the wheel member 60 may engage the floor 70 without interference from the base 12.

While a roller is shown as a preferred wheel member for engaging a floor, other wheel members may be utilized such as a pair of horizontally spaced wheel members.

Figure 22:
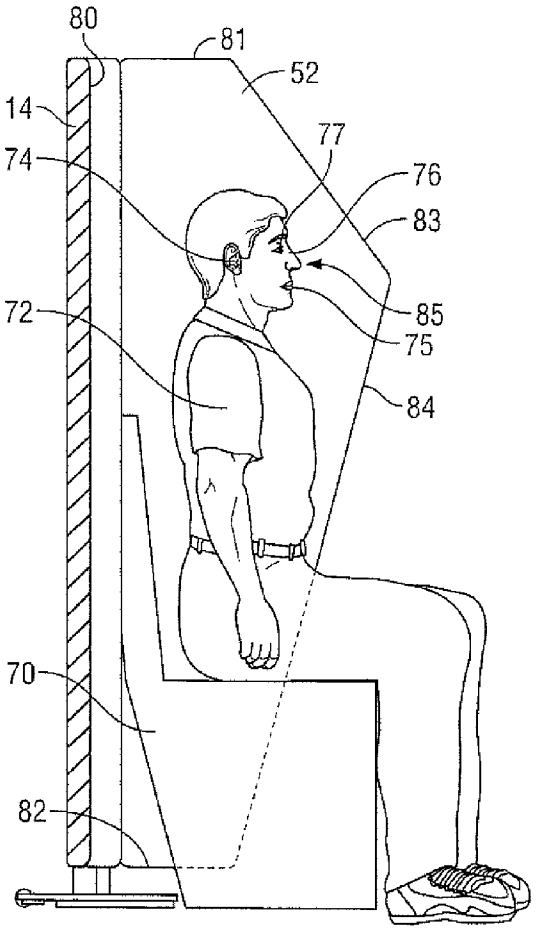
FIG. 22 is a side view along section line B-B' in Figure showing a notional person sitting on the chair.
Figure 21:
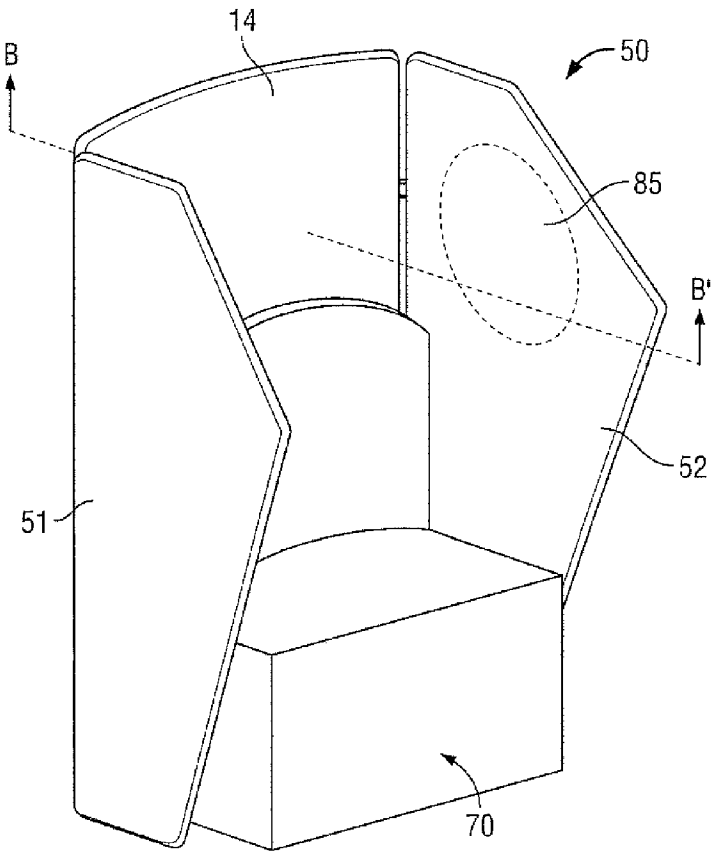
FIG. 21 is a perspective view of the winged privacy screen of FIG. 12 in a second open position with a chair disposed between the wing panels.

Reference is made to FIGS. 21 and 22 which show the panel 50 in a second open position and in use with a chair 70 disposed in front of the central screen 14 between the first wing screen 51 and the second wing screen 52. In FIG. 22, a notional person 72 is shown seated on the chair 70. Each wing screen 51 and 52 has a shape such that the wing screen extends forwardly to a maximum extent at a height proximate the head 76 of the seated person 72 so as to provide optimum lateral blocking of sound at a height above the floor proximate the height of the person's ears 74 and mouth 75 above the floor and optimum visual screening at a height above the floor proximate a height of the person's eyes 77 above the floor. In this regard, each wing screen has a vertical back edge 80, a forwardly extending, preferably horizontal, top edge 81 and a forwardly extending, preferably horizontal bottom edge 82. An upper front edge 83 extends forwardly and downwardly from the top edge 81 to merge with a lower front edge 84 which lower front edge 84 extends forwardly and upwardly from the bottom edge 82. The configuration of the upper front edge 83 and the lower front edge 84 is to provide a forward upward portion indicated 85 of each wing screen laterally of the person's head 76 while somewhat minimizing the area and therefore the mass of the wing screen panel at other areas laterally of the person. Reducing the mass of the other areas of each wing screen assists in preventing the winged panel from tipping forwardly in use. Each wing screen is shown to be polygonal with straight edges, however, the invention is not so limited and the top edge, bottom edge and front edges may be curved.

While the invention has been described with reference to preferred embodiments, many modifications and variations will now occur to a person skilled in the art. For a definition of the invention, reference is made to the following claims.

I claim:

1. A manually movable workplace dividing privacy screen panel comprising:

a flour engaging base, a central screen integrally supported on the base and extending vertically upwardly from the base, the screen having a front surface extending from a screen bottom proximate the base upwardly to a screen top and spanning between a first screen side and a second screen side, the screen having a rear surface extending from the screen bottom proximate the base upwardly to the screen top and spanning between the first screen side and the second screen side, a first wing screen pivotably mounted to the central screen along the first screen side for pivoting about a vertical first axis from a closed position in which the first wing screen overlies the central screen to opened positions in which the first wing screen extends laterally away from the central screen, a second wing screen pivotably mounted to the central screen along the second screen side for pivoting about a vertical second axis from a closed position in which the second wing screen overlies the central screen to opened positions in which the second wing screen extends laterally away from the central screen, the base being elongate and extending along a straight base longitudinal from a first base side edge underneath the first screen side to a second base side edge underneath the second screen side, the base having a front base edge extending from the first base side edge to the second base side edge, the base having a rear base edge extending from the first base side edge to the second base side edge, a wheel member journalled to the base for rotation about a wheel axis parallel the longitudinal, the wheel member carried by the base such that, when the base in a supporting rest position engages the floor to support the central screen to extend vertically upwardly therefrom, the wheel member is spaced from engagement with the floor, however, when the panel is pivoted relative the floor about the wheel axis to a tilted transport position, the wheel member engages the floor for rolling engagement facilitating manual rolling movement of the panel while maintained in the transport position along the floor in a direction normal to the wheel axis, the panel is of a size and weight to be manually moved by one individual between the rest position and the transport position and when in the rest position for repositioning on the floor.

2. A privacy screen panel as claimed in claim 1 wherein the wheel member comprises an elongate roller with a floor engaging surface disposed coaxially about the wheel axis.

3. A privacy screen panel as claimed in claim 2 wherein the base includes a slot vertically there through extending parallel the wheel axis within which the roller is located.

4. A privacy screen panel as claimed in claim 3 wherein the rear base edge is a convex curved rear surface, the wheel member is centered relative the base between the base first side edge and the base second side edge at a location where the convex curved rear surface extends farthest rearwardly relative the longitudinal of the base.

5. A privacy screen panel as claimed in claim 1 wherein the front surface is a concave curved surface as seen in top view and the rear surface being a convex curved rear surface parallel to the front surface.

6. A privacy screen panel as claimed in claim 3 wherein the first base edge being straight and normal to the base longitudinal, the second base side edge being straight and parallel to the first base side edge.

7. A privacy screen panel as claimed in claim 3 wherein the base comprises a planar support plate having as edges the first base side edge, the second base side edge, the rear base edge and the front base edge.

8. A privacy screen panel as claimed in claim 7 including floor engaging feet carried on the support plate extending downwardly from the support plate to engage the floor in the rest position such that the base is supported in the rest position on the floor by merely the engagement of the feet with the floor.

9. A privacy screen panel as claimed in claim 4 wherein the first base edge being straight and normal to the base longitudinal, the second base side edge being straight and parallel to the first base side edge.

10. A privacy screen panel as claimed in claim 9 wherein the base comprises a planar support plate having as edges the first base side edge, the second base side edge, the rear base edge and the front base edge.

11. A privacy screen panel as claimed in claim 10 including floor engaging feet carried on the support plate extending downwardly from the support plate to engage the floor in the rest position such that the base is supported in the rest position on the floor by merely the engagement of the feet with the floor.

12. A privacy screen panel as claimed in claim 1 wherein the first screen side does not extend laterally past the first base side edge and the second screen side does not extend laterally past the second base side edge.

13. A privacy screen panel as claimed in claim 9 wherein the first screen side does not extend laterally past the first base side edge and the second screen side does not extend laterally past the second base side edge.

14. A privacy screen panel as claimed in claim 3 wherein the wheel axis is parallel to the base longitudinal.

15. A privacy screen panel as claimed in claim 4 herein the wheel axis is parallel to the base longitudinal.

16. A privacy screen panel as claimed in claim 9 wherein the wheel axis is parallel to the base longitudinal.

* * * * *